US008905344B1

(12) United States Patent
Bergman

(10) Patent No.: US 8,905,344 B1
(45) Date of Patent: Dec. 9, 2014

(54) HORIZONTAL GRINDER WITH SIDE TILT FEED ROLLER

(75) Inventor: Brian Bergman, Sabetha, KS (US)

(73) Assignee: C. W. Mill Equipment Co., Inc., Sabetha, KS (US)

( * ) Notice: Subject to any disclaimer, the term of this patent is extended or adjusted under 35 U.S.C. 154(b) by 258 days.

(21) Appl. No.: 13/478,578

(22) Filed: May 23, 2012

Related U.S. Application Data

(60) Provisional application No. 61/494,696, filed on Jun. 8, 2011.

(51) Int. Cl.
*B02C 13/286* (2006.01)

(52) U.S. Cl.
USPC ..... 241/186.4; 241/285.3

(58) Field of Classification Search
CPC ..... B02C 13/286
USPC ..... 241/186.4, 285.3
See application file for complete search history.

(56) References Cited

U.S. PATENT DOCUMENTS 4,867,382 A * 9/1989 Manschwetus ..... 241/101.2
5,881,959 A 3/1999 Hadjinian et al.
6,641,065 B2 11/2003 Bardos et al.
7,441,718 B2 10/2008 Seaman et al.
7,611,085 B2 11/2009 McIntyre et al.
2004/0135018 A1 7/2004 Bonner
2009/0224087 A1 9/2009 Ragnarsson

FOREIGN PATENT DOCUMENTS

DE 3412155 A1 10/1985

* cited by examiner

*Primary Examiner* — Mark Rosenbaum
(74) *Attorney, Agent, or Firm* — Erickson Kernell Derusseau & Kleypas, LLC

(57) ABSTRACT

A feed roller assembly for a horizontal grinder having a hammer mill and a conveyor moving material to be ground or processed toward the infeed side of the hammer mill includes a side tilt frame hingedly connected along a first axis to a hammer mill frame and a feed roller frame hingedly connected along a second axis to the side tilt frame. In a first position, the side tilt frame and the feed roller frame are downwardly hinged so as to engage the feed roller with feed material. In a second position, the feed roller frame is hinged upward about the second axis to disengage the feed roller from the feed material and the hammer mill frame. In a third position, the side tilt frame is further hinged outward about the first axis to pivot the entire feed roller assembly away from the hammer mill frame.

4 Claims, 4 Drawing Sheets

HORIZONTAL GRINDER WITH SIDE TILT FEED ROLLER

CROSS-REFERENCE TO RELATED APPLICATIONS

This application claims the benefit of U.S. provisional patent application Ser. No. 61/494,696, filed Jun. 8, 2011, under 35 U.S.C. §119(e).

FIELD OF THE INVENTION

This invention relates to horizontal grinders, and in particular to a horizontal grinder with a side tilt feed roller.

BACKGROUND

Industrial grinders, in general, and horizontally fed hammer mills, in particular, are used to process materials into smaller pieces. Large industrial grinders are used for grinding wood, such as wood from storm debris, land clearing, building demolition or other sources into chips which can be disposed of or used for mulch. Such grinders are also used for grinding old tires and solid waste. A common configuration of an industrial grinder is a horizontal mill with an end feed system that includes a conveyor, a press wheel, a wheel pivot mount, and a hammer mill box or frame intended to enclose the hammer mill during the feeding process. The conveyor is normally a slide chute, drag chains, or a conveyor belt or chain used to move material from the input feed chute into the enclosed hammer mill assembly. In a horizontal hammer mill, the feed material is typically fed into the hammer mill by a conveyor belt or chain.

Hammer mills may utilize a feed roller that rides on or presses down against the feed material. The feed roller generally comprises a rotating drum positioned on the infeed side of the hammer mill above the inlet horizontal conveyor. The feed roller may be a passive roller wheel that travels over the top of the feed material to hold the material down or compact it before entering the hammer mill. Alternatively, the feed roller may be power driven—i.e. the roller turns and pushes the feed material into the hammer mill assembly for processing. In order to facilitate the movement of the feed roller over the top of the material, the feed roller assembly may allow for vertical deflection to allow the roller to travel vertically over vertical variations of the feed material. Commonly, this vertical deflection of the feed roller is achieved by a pivot pin, hinge or sliding mechanism located on top, in front, or behind the hammer mill frame on the feed roller assembly. In some applications, the feed roller is biased downwardly by hydraulics or other means in order to hold the material down as it is being ground. A feed roller may be used on material entering the hammer mill or material exiting the hammer mill.

The hammers in a hammer mill are typically heavy and require frequent maintenance. Hammers for some hammer mills may weigh over 100 pounds each. The hammers are typically bolted to a cylindrical body of the hammer mill. Generally, the hammers have hammer tips and other wear parts bolted or pinned to the hammer. Additionally, a screen is located below the hammer mill and typically made of thick steel with variously sized holes. The hammer mill grinds against the screen grates as part of the grinding process. The hammer mill assembly and screens require frequent maintenance including replacing worn hammer tips, wear parts and screens due to wear and size changes. In a horizontally fed hammer mill, the feed roller must be moved away from the hammer mill so that the parts can be regularly replaced or maintained.

The configuration of enclosing the hammer mill and incorporating input and output feeder systems and rollers has presented challenges associated with maintaining the hammer mill assembly as described above. Typically, a pair of hydraulic cylinders lift the feed roller upward from the hammer mill to provide access for maintenance and repair of the hammer mill. Past attempts to hinge tilt the top of the mill box and feed roller assembly include tilting the feed roller either forward or backward, relative to the direction of the conveyor, to gain access to the hammer mill assembly.

A problem with such an arrangement is that the feed roller has a tendency to fall back down into place adjacent the hammer mill. Hammer mills of this design may typically have a safety lock or other device that would prevent the feed roller from coming down into its working position. However, it is often a problem that a worker may not engage the safety devices, the safety devices fail during use or the safety devices no longer operate. For all of these reasons, a problem with horizontally fed hammer mills is that the feed roller has a tendency to come down into its working position and can injure or crush a worker who is in a position to maintain the hammer mill. U.S. Published Patent Application 2004/0135018 by Bonner attempts to correct this problem by moving the center of gravity of the feed roller assembly such that when the feed roller assembly has been lifted into the open position by the lifting mechanism, the center of gravity of the feed roller assembly is on the side of the assembly that pivots away from the hammer mill. This results in the feed roller assembly tending to fall to the open position rather than towards the hammer mill and the closed position. Thus, if the safety devices or lifting mechanism fail, the feed roller assembly would not fall towards the worker or the hammer mill.

However, the forward or backward tilting feed rollers of the prior art provide only limited worker access to the hammer mill assembly. Because the feed roller tilts forward or backward on the conveyor, a worker's access and area of work is limited. Additionally, feed roller units that tilt up on the engine side of the hammer mill create an additional hazard in that dust and debris that may have built up on the roller assembly dumps into the engine area when the assembly is tilted.

What is needed to address the problems of the prior art is a hinged feed roller assembly for horizontal end feed style grinders or hammer mills that allow greater worker access to the hammer mill assembly and screens while not subjecting the worker to risk of injury due to failure of the lifting mechanism or safety devices.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, a horizontal grinder with a side tilt feed roller to improve upon the shortcomings of the prior art.

A horizontal grinder with a side-tilt feed roller is disclosed. The horizontal grinder includes a hammer-mill mounted on a hammer mill frame and rotatable about a hammer mill axis. The hammer mill frame includes first and second side frame assemblies extending on opposite sides of the hammer mill and in front of the hammer mill on opposite sides of a hammer mill feed path.

A side-tilt frame is hingedly coupled to the first side frame assembly and pivotable about a tilt frame axis extending transverse to the hammer mill axis. The side-tilt frame is pivotable about the tilt frame axis between a closed position in which the tilt frame extends above and across the hammer mill and is supported on the hammer mill frame, and an open position.

A feed roller rotatably coupled to a feed roller carrier is hingedly coupled to the side-tilt frame about a roller carrier axis extending substantially transverse to the tilt frame axis. When the side-tilt frame is in the closed position the feed roller carrier is pivotable about the roller carrier axis to pivot the feed roller carrier and the feed roller between a working position extending across the material feed path between the first and second side frame members and a raised position in which the roller extends above the first side frame member. When the feed roller carrier and the feed roller are advanced to the raised position the feed roller and feed roller carrier are pivotable with the side-tilt frame about the tilt-frame axis from the closed to an open position wherein a center of gravity of the side tilt frame, the roller carrier and the feed roller extends past a vertical plane extending through the tilt frame axis.

It is foreseen that the present invention may be used in combination with any configuration of a horizontal grinder including, but not limited to, electric or diesel powered, stationary or portable, track or wheel mounted grinders.

DESCRIPTION OF THE DRAWINGS

Illustrative embodiments of the invention are described in detail below with reference to the attached drawing figures, and wherein.

DETAILED DESCRIPTION

Figure 1:
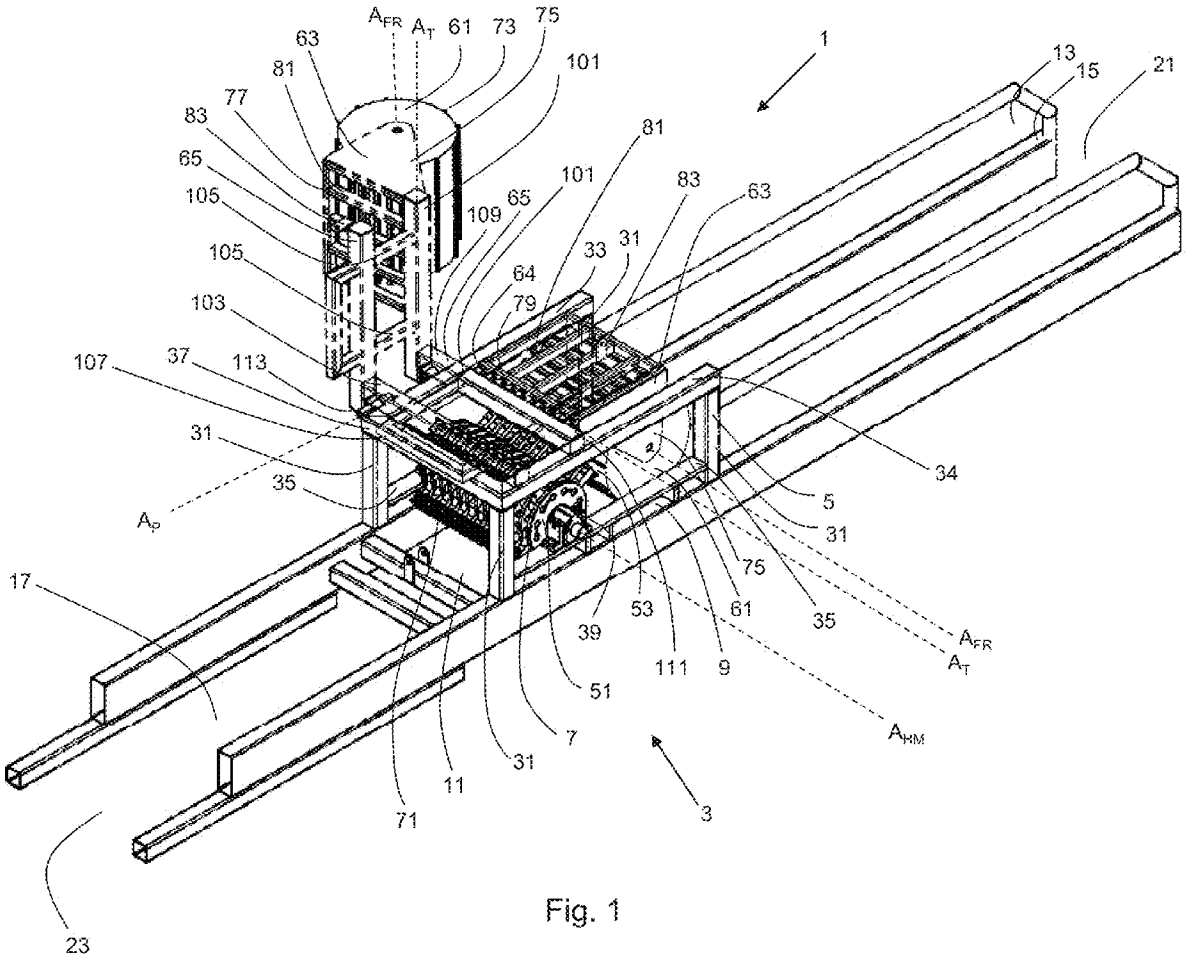
FIG. 1 is a perspective view of the horizontal grinder showing the feed roller assembly in the first position and third position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" is used with reference to an element is the language intended to be limited to one of the elements specified, or any other similarly limited number of elements.

Referring now to the drawings in more detail, the reference number 1 generally designates a feed roller assembly according to the present invention. The feed roller assembly 1 is a component part of a horizontally fed industrial grinder 3 having a hammer mill frame 5 with a hammer mill 7 mounted longitudinally, transverse to the direction of conveyance therein. The hammer mill has an infeed side 9 and a discharge side 11. Material to be ground or processed by the hammer mill 7 is moved towards the infeed side 9 of the hammer mill 7 with a first conveyor 15 forming a floor thereof. The first conveyor 15 moves material to be processed or ground in the hammer mill 7 toward the infeed side 9 of the hammer mill 7. A second conveyor 17 moves the processed or ground material away from the discharge side 11 of the hammer mill 7 to an elevator, hopper or other output location (not shown). The end 13 of the grinder 3 opposite the output location is normally referred to as the front end 21 of the grinder 3; the end of the grinder 3 adjacent the elevator or output location (not shown) is normally referred to as the rear end 23 of the grinder 3.

The hammer mill frame 5 is generally disposed around the hammer mill 7. The hammer mill frame 5 comprises four vertical leg members 31, two upper horizontal side members 33, 34, two lower horizontal side members 35, and an upper horizontal rear member 37. Journal bearings 39, or other rotatably supporting fixtures, are attached to the lower side members 35 of the frame 5. The hammer mill 7 is rotatably mounted to and supported by the journal bearings 39.

As known to one of ordinary skill in the art, the hammer mill 7 includes a generally cylindrical body 51 having hammer tips and other wear parts 53 detachably connected to the cylindrical body 51. The hammer mill 7 may be driven by a motor (not shown) or other such device to drive the rotation of the hammer mill 7.

During grinding operations, an infeed feed roller 61 is contained within the hammer mill frame 5 on the infeed side 9 of the hammer mill 7 with an axis of rotation $A_{FR}$ transverse to the direction of the conveyance and generally parallel to the axis of rotation $A_{HM}$ of the hammer mill 7.

The feed roller assembly 1 generally comprises a feed roller 61, a feed roller frame or carrier 63, and a side tilt frame 65. The feed roller 61 comprises a cylindrical body 71 having radial projections 73 for engaging the feed material. The feed roller 61 is rotatably attached to the feed roller frame 63. As shown in FIG. 1, the feed roller frame 63 includes triangular mounting members or forks 75 disposed on opposing sides of the frame 63, forward frame member 77, and rear frame member 79. The frame is reinforced by reinforcement members 81 connected to the forward and rear frame members 77, 79. The feed roller 61 is received between and rotatably connected to the triangular mounting members 75. A lifting tab or flange 83 is attached to a reinforcement member 81 to aid in installation and/or pivoting of the feed roller frame 63 as described below.

The side tilt frame 65 comprises a forward transverse member 101, rear transverse member 103, side members 105, and rear member 107. The side members 105 attach to the forward transverse member 101 and rear transverse member 103 such that the distal ends 109, 111 of the transverse members 101, 103 extend leftwardly and rightwardly of the side members 105.

The leftward distal ends 109 of the transverse members 101, 103 of the side tilt frame 65 are hingedly connected along a first axis $A_P$ with hinges 113 to the leftward upper side member 33 of the hammer mill frame 5. The rear frame member 79 of the feed roller frame 63 is hingedly connected along a second axis $A_T$ with hinges 64 to the forward transverse member 101 of the side tilt frame 65. The first axis $A_P$ is generally parallel to the direction of conveyance; the second axis $A_T$ is generally transverse to the direction of conveyance.

Figure 2:
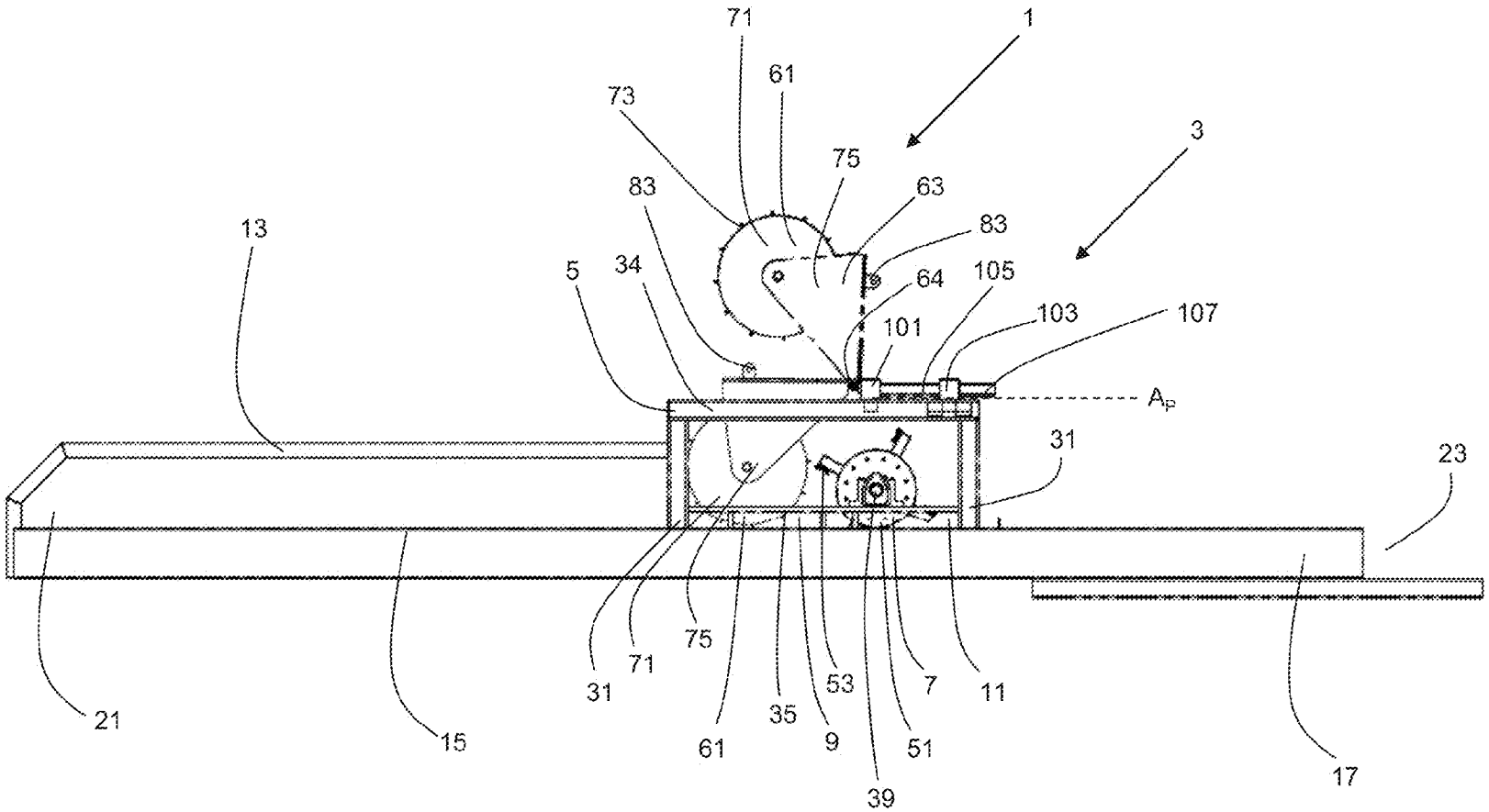
FIG. 2 is a side view of the horizontal grinder showing the feed roller assembly in the first position and second position.
Figure 3:
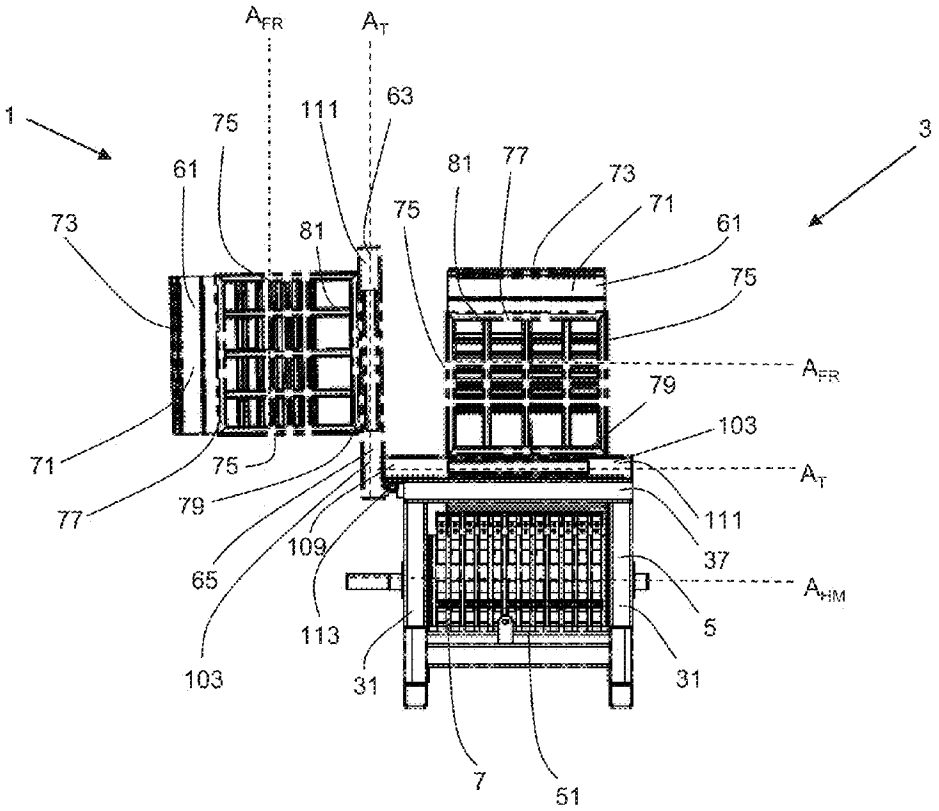
FIG. 3 is a front view of the horizontal grinder showing the feed roller assembly in the second position and third position.

Referring now to FIGS. 1, 2 and 3, in a first position, or a use position, the rightward distal ends 111 of the transverse members 101, 103 of the side tilt frame 65 rest on the rightward upper side member 34 of the hammer mill frame 5. The feed roller frame 63 hinges to the downward position along the second axis $A_T$ such that the feed roller 61 and triangular mounting members 75 are received within the hammer mill frame 5. In this first position the feed roller 61 is positioned to engage the feed material. The feed roller 61 and/or the feed roller frame 63 may be downwardly urged using a hydraulic actuator (not shown) or other urging means as known to one of ordinary skill in the art.

In a second position, the rightward distal ends 111 of the transverse members 101, 103 of the side tilt frame 65 rest on the rightward upper side member 34 of the hammer mill frame 5. The feed roller frame 63 hinges about the second axis $A_T$ to the upward position such that the feed roller 61 and the triangular mounting members 75 pivot above the upper side members 33, 34 of the hammer mill frame 5. In this second position, the feed roller 61 is disengaged from the feed material. Pivoting of the feed roller frame 63 may be assisted by hydraulic actuators or other power-assist means as known to one of ordinary skill in the art.

Figure 4:
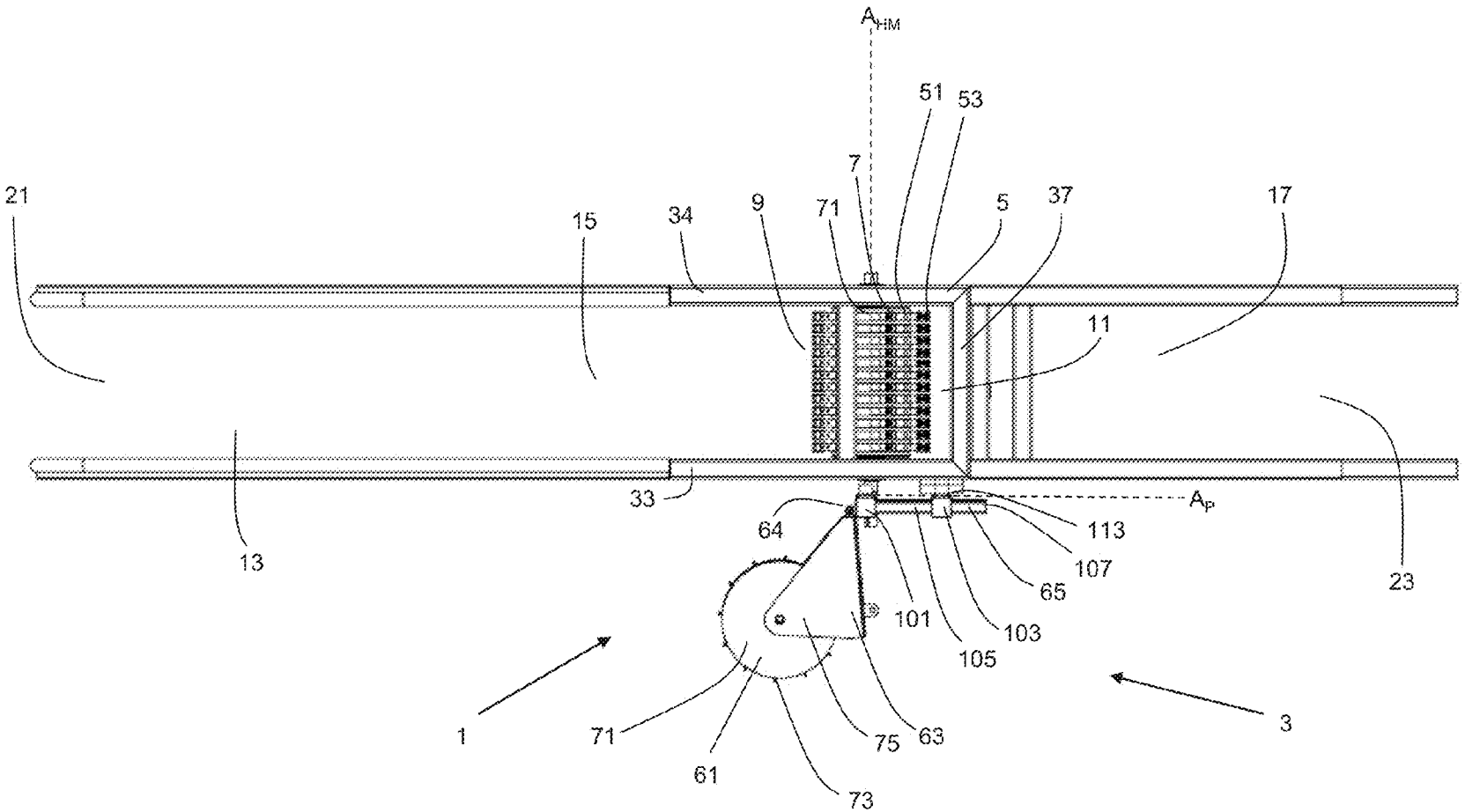
FIG. 4 is a top view of the horizontal grinder showing the feed roller assembly in the third position.

Referring now to FIGS. 1, 3, and 4, in a third position, the feed roller frame 63 is hinged about the second axis $A_T$ as described in the second position. Additionally, the side tilt frame 65 is hinged upward about the first axis $A_P$ such that the rightward distal ends 111 of the transverse members 101, 103 of the side tilt frame 65 are pivoted up and away from the hammer mill frame 5. In this third position, the entire feed roller assembly 1 is pivoted away from the grinder 3 allowing a worker full access to the hammer mill 7 for maintenance and repair. It is foreseen that pivoting of the side tilt frame 65 may be assisted by hydraulic actuators or other power-assist means as known to one of ordinary skill in the art.

The feed roller assembly 1 has a center of gravity. The feed roller assembly may preferably be configured so that in the third position, described above and shown in FIGS. 1, 3 and 4, the center of gravity of the feed roller assembly 1 is positioned to fall away from the hammer mill frame 5. In the presently described embodiment, as the feed roller assembly 1 is rotated from the second position to the third position about hinges 113, the center of gravity of the feed roller assembly 1 will move from the rightward side to the leftward side of the first axis $A_P$. As the center of gravity of the feed roller assembly 1 moves to the leftward side of the first axis $A_P$, the feed roller assembly will tend to fall leftwardly, or away from the hammer mill frame 5, under gravity.

A shield (not shown) may be mounted on the feed roller frame 63 in closely spaced relation to the feed roller 61 and includes a respective concavity for the feed roller 63. The shield prevents material from being pulled over the feed roller 61 as the feed roller 63 turns and pushes material towards the hammer mill 7.

The feed roller 63 may be driven by a motor (not shown), such as a hydraulic motor. Alternatively, the feed roller 63 may be a passive or unpowered feed roller 63 that rolls over the top of the feed material being fed to the hammer mill 7.

METHOD OF PIVOTING FEED ROLLER

During grinding operations, the infeed roller 61 is in the first position, or use position, within the frame 5 and adjacent the hammer mill 7. When an operator desires to access the hammer mill 7 for maintenance, repairs or inspection, all components of the horizontally fed industrial grinder 3 should be powered off and appropriate safety measures, such as a lock-out/tag-out procedures, implemented. As explained above, all pivoting of the feed roller frame 63 or side tilt frame 65 will likely be assisted by hydraulic, pneumatic, or electronic actuators or the like. Next, the operator pivots the feed roller frame 63 upward to the second position about the hinged axis $A_T$. FIG. 2 illustrates the feed roller frame 63 pivoting from the first position to the second position. Once the feed roller frame 63 is fully pivoted and secured in the second position, the operator may pivot the assembly 1 to the third position by pivoting the side tilt frame 65 about hinged axis $A_P$. FIG. 3 illustrates the side tilt frame 65 pivoting from the second position to the third position. The side tilt frame 65 may be rotated to various angles that cause the center of gravity of the assembly 1 to fall away from the second position, as described above. The specific angle of rotation depends on the geometry of the assembly 3 and the associated center of gravity of the assembly 3. Finally, the operator may secure the assembly 1 in the third position in order to safely access the hammer mill 7 and various internal components.

It is foreseen that the hinging or pivoting means of the present invention as described above to pivot a feed roller assembly 1 away from the grinder 3 may be applied to infeed feed rollers, discharge feed rollers or to multiple feed rollers of a single grinder whether on the infeed or discharge sides of the hammer mill 7.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A horizontal grinder with a side tilt feed roller assembly comprising:

a hammer mill frame disposed around and supporting a hammer mill assembly rotating about a hammer mill axis;

a side-tilt frame hingedly coupled to a first side frame assembly of the hammer mill frame above the hammer mill and pivotable about a tilt frame axis extending substantially transverse to the hammer mill axis and between a closed position extending across said hammer mill frame and above said hammer mill and an open position;

a feed roller rotatably coupled to a feed roller carrier hingedly coupled to the side-tilt frame about a roller carrier axis extending substantially transverse to the tilt frame axis; said feed roller carrier pivotable about the roller carrier axis between a use position in which said feed roller is positioned in front of said hammer mill assemlby to engage material fed into the hammer mill assembly and a raised position in which said feed roller and said feed roller carrier are positioned over said side-tilt frame;

said feed roller and said feed roller carrier in the raised position being pivotable with the side-tilt frame about the tilt-frame axis between the closed and open positions;

wherein when the side-tilt frame is advanced to the open position, the center of gravity of the side-tilt frame, the feed roller and the feed roller carrier extends past a vertical plane through said tilt frame axis.

2. The horizontal grinder as in claim 1 wherein said hammer mill frame further includes a second side frame assembly and said first and second side frame assemblies extend forward from said hammer mill to define a material feed path therebetween to said hammer mill; wherein when said side-tilt frame is pivoted to said closed position and said roller carrier is pivoted to said use position, said feed roller extends into the material feed path between said first and second side frame assemblies.

3. The horizontal grinder as in claim 2 further comprising a feed conveyor for conveying material to said horizontal grinder along the material feed path.

4. A horizontal hammer mill assembly with a side-tilt feed roller, the horizontal hammer mill comprising;

a hammer-mill mounted on a hammer mill frame and rotatable about a hammer mill axis;

said hammer mill frame including first and second side frame assemblies extending on opposite sides of said hammer mill and in front of said hammer mill on opposite sides of a hammer mill feed path;

a side-tilt frame hingedly coupled to said first side frame assembly and pivotable about a tilt frame axis extending transverse to the hammer mill axis; said side-tilt frame pivotable about said tilt frame axis between a closed position in which said tilt frame extends above and across said hammer mill and is supported on said hammer mill frame, and an open position;

a feed roller rotatably coupled to a feed roller carrier hingedly coupled to the side-tilt frame about a roller carrier axis extending substantially transverse to the tilt frame axis; when said side-tilt frame is in said closed position said feed roller carrier is pivotable about the roller carrier axis to pivot the feed roller carrier and the feed roller between a working position extending across the material feed path between the first and second side frame members and a raised position in which the roller extends above the first side frame member; and when said feed roller carrier and said feed roller are in said raised position said feed roller and said feed roller carrier are pivotable with the side-tilt frame about the tilt-frame axis from the closed position to the open position wherein a center of gravity of said side tilt frame, said roller carrier and said feed roller extends past a vertical plane extending through the tilt frame axis.

* * * * *